United States Patent [19]

Gibbs

[11] Patent Number: 4,962,949

[45] Date of Patent: Oct. 16, 1990

[54] BOOK BLANKET

[76] Inventor: Mary Lou Gibbs, 4115 E. Zion, Tulsa, Okla. 74115

[21] Appl. No.: 378,691

[22] Filed: Jul. 10, 1989

[51] Int. Cl.[5] ..... B42D 3/00

[52] U.S. Cl. ..... 281/35; 283/117; 281/42; 281/45; 281/51; 281/20; 281/29

[58] Field of Search ..... 281/45, 42, 35, 51, 281/20, 29; 283/117, 63.1, 64

[56] References Cited

U.S. PATENT DOCUMENTS

| | | | |
|---|---|---|---|
| 2,039,116 | 4/1936 | Rice | 281/20 |
| 2,224,703 | 12/1940 | Spencer | 281/20 |
| 3,099,268 | 7/1963 | Smith | 281/45 |
| 3,208,772 | 4/1965 | Dahlstrand et al. | 281/15.1 |
| 3,719,161 | 3/1973 | Wegner | 281/42 |
| 3,891,240 | 6/1975 | DuCorday | 281/29 |
| 4,157,626 | 6/1979 | Bedinghaus | 281/45 |
| 4,240,543 | 12/1980 | McKee | 283/81 |
| 4,516,871 | 5/1985 | Leitman | 283/38 |

*Primary Examiner*—Frank T. Yost
*Assistant Examiner*—Thomas Hamill, Jr.
*Attorney, Agent, or Firm*—William S. Dorman

[57] ABSTRACT

A blanket for covering the printed document comprising an elongated sheet of flexible transparent material having a vertical height substantially equal to the vertical height of the document which is covered and a horizontal length substantially equal to the horizontal width of the document to be covered, the blanket having vertical pouches at the opposite horizontal ends thereof and adapted to be positioned adjacent to the vertical side edges of the document to be covered, the pouches being filled with a material constituting weights.

7 Claims, 2 Drawing Sheets

BOOK BLANKET

BACKGROUND OF THE INVENTION

1. Field of the Invention

The present invention relates to a transparent sheet, or blanket, which can be sized as needed for the purpose of covering books, papers, reference materials or any other valuable materials to prevent soilage or spillage on the pages.

2. Prior Act

When a person is cooking, following a recipe in a cookbook, it is desirable to prevent the pages from flipping to another recipe. It is also desirable to prevent accidental spillage of cooking ingredients on the open pages of the cookbook. It is further desirable to keep reference books open to the correct page when copying reference material or to hold books open when studying for examinations. It is still further desirable to protect valuable unlendable reference books and other prize books.

A patentability search was conducted on the present invention and the following listed U.S. Patents were uncovered in the search:

| U.S. Pat. No. | Inventor | Date |
|---|---|---|
| 3,099,268 | Smith | 7-30-63 |
| 3,719,161 | Wegner | 3-6-73 |
| 3,809,352 | Mathias | 5-7-74 |
| 4,157,626 | Bedinghaus | 6-12-79 |
| 4,159,836 | Tarr | 7-3-79 |
| 4,572,546 | Morrison | 2-25-86 |
| 4,681,291 | Holladay | 7-21-87 |

None of the above patents is sufficiently close to the present invention to require any comments.

SUMMARY OF THE INVENTION

A book blanket made of transparent material, preferably plastic, having a central flat portion adapted to overlie the pages of an open book or other document has been provided with two side pouches which are stitched or otherwise sealed around three edges thereof so as to enclose therein a quantity of flat-sided glass pellets. The weight of the two pouches containing the glass pellets will keep the book or the reference material lying flat and prevents soilage.

DETAILED DESCRIPTION OF THE DRAWINGS

As indicated above, it is desirable to keep books, such as textbooks, open to the correct page or pages and, at the same time, to prevent spillage on the open pages of the book.

Figure 1:
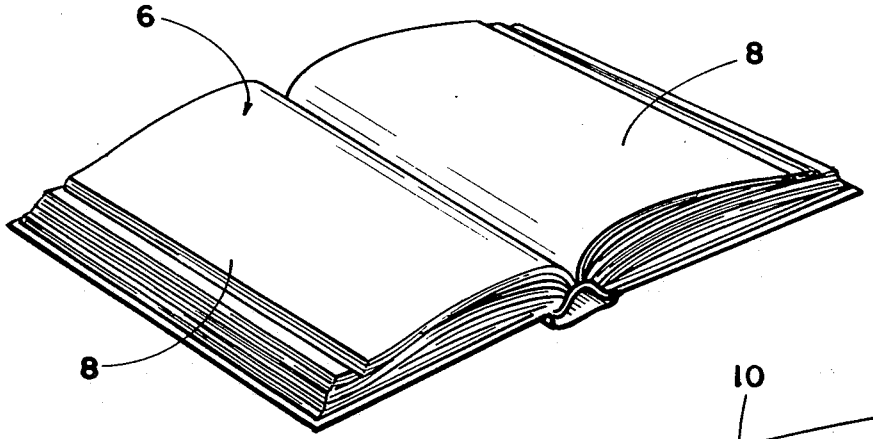
FIG. 1 is a perspective view of an open book to which the book blanket of the present invention is to be applied.

Referring to the drawings in detail, FIG. 1 shows a book 6, such as a cookbook, for example, which is open to expose pages 8. For the purposes of this description, it will be assumed that a desirable recipe appears on one or both of the pages 8 of the book 6. If a person were cooking, following the recipe on one of the pages 8, there is always a possibility that a page might flip and make it necessary for the cook to relocate the recipe. It is also possible that the cook might spill some of the cooking ingredients on the exposed pages 8, thereby requiring immediate attention to the book. Even if the spilled material were removed immediately from the pages 8, it might nevertheless stain or spoil the pages of the book.

Figure 2:
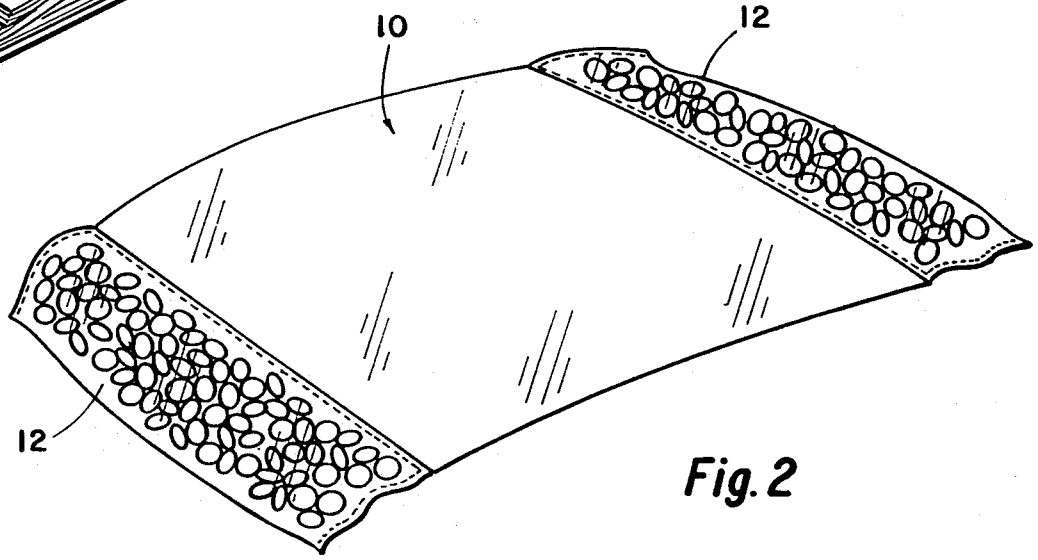
FIG. 2 is a perspective of the book blanket of the present invention.
Figure 3:
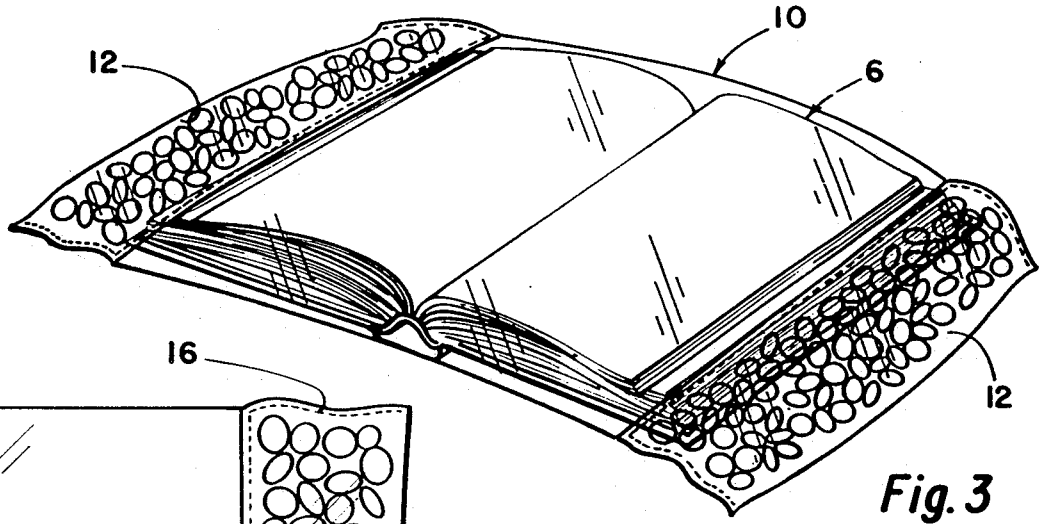
FIG. 3 is a perspective showing the book blanket of FIG. 2 overlying the book of FIG. 1 with certain hidden parts being shown in dotted lines.
Figure 4:
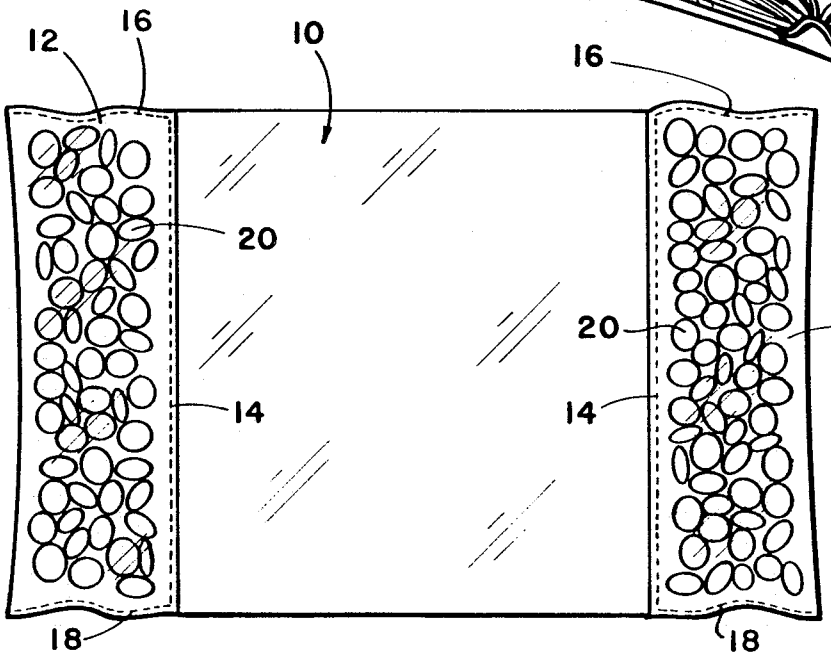
FIG. 4 is a plan view of the book blanket of the present invention.

FIGS. 2, 3 and 4 show a book blanket 10 which is essentially a flat piece of transparent plastic material having its end folded over to form side pouches 12. The pouches 12 are preferably stitched around three edges 14, 16 and 18 so as to enclose therein a quantity of flat sides glass pellets 20. The pellets need not be made of glass but they could be made of any plastic material. Instead of stitching, the seams 14, 16 and 18 can be closed by glue or thermal bonding.

Turning now to FIG. 3, the weight of the two pouches containing the glass pellets 20 will keep the book or reference material lying flat to prevent spillage onto the book directly. If any material should spill onto the book blanket, it can be readily wiped off without spoiling the book.

It is contemplated that the book blanket can be produced in several sizes. Purely by way of illustration, the finished book blanket can be 10 inches by 16½ inches. Another desirable size is 15 inches by 30 inches. These two sizes of blankets can be made from flat sheets of plastic material 10 inches by 23 inches and 15 inches by 36 inches, respectively; after folding the ends over to form pouches approximately 3 inches wide we reach the finished dimensions set forth above. The foregoing sizes will suit the needs of most books.

When the blanket 10 is placed over the book 6, as shown in FIG. 3, the pouches 12 will be along the side edges of the open book so that all of the printed material will be readable through the central portion of the blanket.

The material selected for the book blanket itself is preferably plasticized PVC flexible sheets 1/64 inch or approximately 0.016 mil. thick. Other suitable transparent flexible sheet material can be employed. The weights are preferably flat glass marbles (clear) having an average diameter of 9/16 inch. However, these marbles, or weights, can be made of a variety of colored glass beads, or flat marbles, tumbled stones, metal marbles or discs, or plastic pellets. If the seams 12, 14 and 16 are sealed the pouches 12 can be filled with clear or colored liquid.

The thread which is used to seal the seams as shown in the drawings is preferably polyester wrapped cotton thread—all purpose. However, other suitable threads may be employed. Also, thread stitching can be replaced by heat sealing, glue sealing, or heat stitching. If any one of the sealing means referred to above provides a liquid-tight seal then, as indicated above, the pouches can be filled with liquids.

The present invention can be used to keep a book open thereby enabling cooks to use their hands for mixing recipes; students to eat, drink, etc. while studying; researchers, i.e. law clerks to use both hands on their computers, typewriters, word processors, etc, in copying material; construction engineers could cover their building plans in inclement weather; dirty handed mechanics who need to refer to expensive manuals; libraries and museums to protect and display rare and valuable books, manuscripts or documents; to cover educational books used to teach handicapped children in hospitals, those who often drool or dribble fluids from the mouth. The book blanket of the present invention does not need to take up permanent counter top space. After cleaning (if necessary) the blanket is simply rolled up (each end towards the middle) and stored in a drawer. The book blanket is preferably wiped with a damp cloth and dried well with a soft cloth before storing. Needless to say, one would not lay a wet book blanket of the present invention on printed paper or any surface which might be damaged by moisture.

Whereas, the present invention has been described in particular relation to the drawings attached hereto, other and further modifications, apart from those shown or suggested herein, may be made within the spirit and scope of this invention.

I claim:

1. A blanket for covering a printed document of the type having a vertical height, vertical side edges and a horizontal dimension comprising an elongated sheet of flexible transparent material having a vertical height substantially equal to the vertical height of the document to be covered and a horizontal length substantially equal to the horizontal dimension of the document to be covered, the blanket having opposite horizontal ends and vertical pouches at the opposite horizontal ends of the blanket adapted to be positioned adjacent to the vertical side edges of the document to be covered, the pouches being filled with a material constituting weights.

2. A blanket as set forth in claim 1, wherein the pouches are formed by folded-over horizontal side ends of the blanket, each folded-over end being attached to the blanket itself along a vertical edge, the resulting upper and lower edges of the pouches being attached along horizontal lines so that each pouch forms a closed chamber.

3. A blanket as set forth in claim 2, wherein the edges of each pouch are attached to each other and to the blanket by means of stitching.

4. A blanket as set forth in claim 2, wherein the edges of each pouch are attached to each other and to the blanket by means of glue.

5. A blanket as set forth in claim 2, wherein the edges of each pouch are attached to each other and to the blanket by means of thermal bonding.

6. A blanket as set forth in claim 1, wherein the pouches are filled with solid particles.

7. A blanket as set forth in claim 1, wherein the pouches are filled with liquid material.

* * * * *